United States Patent [19]

Corrigan

[11] 3,930,859

[45] Jan. 6, 1976

[54] PHOTOGRAPHIC PROCESS, SYSTEM, RECORDING MEDIUM AND MONOWEB

[75] Inventor: Richard A. Corrigan, Temple City, Calif.

[73] Assignee: Bell & Howell Company, Chicago, Ill.

[22] Filed: July 20, 1973

[21] Appl. No.: 381,183

[52] U.S. Cl. ..... 96/50 R; 96/76 R; 96/95

[51] Int. Cl.[2] ..... G03C 5/26; G03C 1/06

[58] Field of Search ..... 96/76 R, 50, 95

[56] References Cited

UNITED STATES PATENTS

| | | | |
|---|---|---|---|
| 2,698,798 | 1/1955 | Land | 96/76 R |
| 2,774,668 | 12/1956 | Rogers | 96/76 R |
| 2,819,166 | 1/1958 | Goldschein | 96/76 R |
| 3,179,517 | 4/1965 | Tregillus | 96/50 R |
| 3,260,598 | 7/1966 | Yutzy et al. | 96/95 |
| 3,415,651 | 12/1968 | von Konig et al. | 96/95 |
| 3,419,395 | 12/1968 | von Konig et al. | 96/95 |
| 3,468,664 | 9/1969 | Stewart | 96/50 R |
| 3,518,088 | 6/1970 | Dunn et al. | 96/95 |
| 3,576,632 | 4/1971 | Bornemisza | 96/50 |
| 3,729,314 | 4/1973 | Haas | 96/76 R |
| 3,759,712 | 9/1973 | Kammerer et al. | 96/63 |

*Primary Examiner*—Mary F. Kelley

*Attorney, Agent, or Firm*—Nilsson, Robbins, Bissell, Dalgarn & Berliner

[57] ABSTRACT

An improved photographic processing system and process are provided. The system includes a novel photographic recording medium comprising a layer of silver halide emulsion, a barrier layer disposed on a surface thereof, the barrier layer being soluble in aqueous alkali but insoluble in water and acidic media, and an acidic developer disposed as a layer on the outer surface of the barrier layer or mixed therewith. The developer is activatable at an alkaline pH. A novel processing web comprising a support containing an alkali and a free water source is also provided, which web is adapted for contacting the layer containing developer to initiate development of the silver halide. The developer thus is isolated from alkali and from the emulsion prior to developing. The process includes exposure of the recording medium, followed by the described contacting for development of a visible image. Nucleating and complexing agents can be included in the web, to remain with the web, to provide a positive print by diffusion transfer and/or to aid in stabilization of the photographic emulsion.

10 Claims, 3 Drawing Figures

FIG. 1.
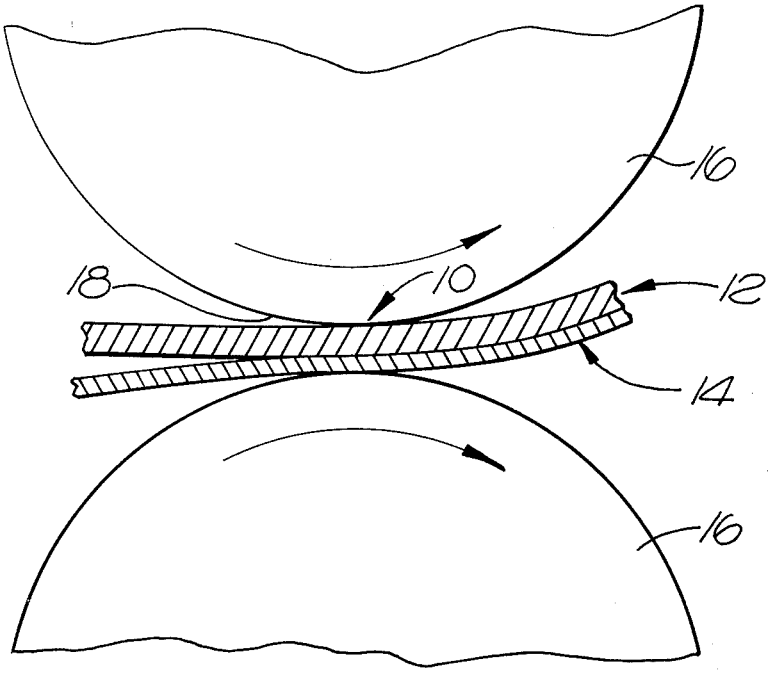
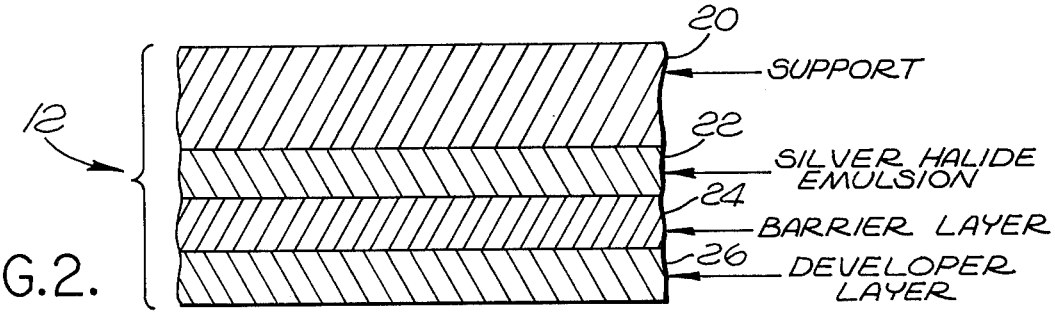
FIG. 2.
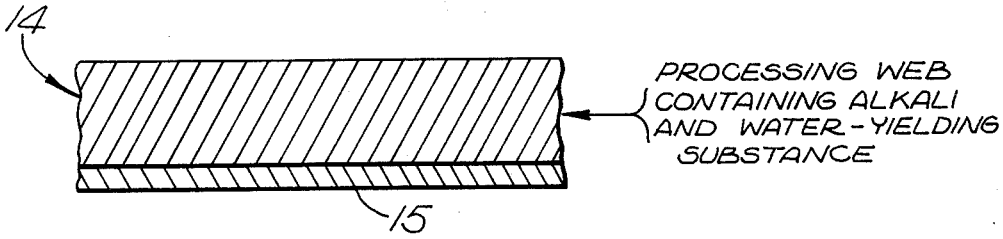
FIG. 3.

PHOTOGRAPHIC PROCESS, SYSTEM, RECORDING MEDIUM AND MONOWEB

FIELD OF THE INVENTION

The present invention generally relates to a photographic processing system and process, more particularly to a system and process which isolate a silver halide emulsion, developer and alkaline activator until development is carried out.

BACKGROUND AND SUMMARY OF THE INVENTION

In the usual photographic process, a silver halide emulsion is exposed to a light pattern, then developed by the application thereto of an alkaline solution of developer, after which a liquid stabilizer or fixer renders the developed image permanent. Such a two step procedure is time consuming. Accordingly, one step processes have been investigated which generally employ a monoweb, that is, a web which may contain developer, alkaline activator for the developer and fixer. The web contacts the exposed silver halide emulsion to accomplish the desired eveloping and fixing in a single step. Such monowebs are subject to deterioration of the developer, since it is in an alkaline environment and therefore subject to atmospheric oxidation. Moreover, reaction between the developer and fixer may occur before use of the monoweb, contributing to a short shelf life.

Other monowebs have been employed which contain only the alkaline activator, while the recording medium comprises a silver halide emulsion directly over which is coated a layer containing both the developer and the fixer. The recording media in such systems are subject to fogging due to premature reaction between the developer and the silver halide. Moreover, reaction between the fixer and developer may occur. Accordingly, the shelf life of such recording madia is short.

Attempts to separate the silver halide, developer and fixer through the use of gelatin layers have been largely ineffective, in part due to difficulties in joining the layers while controlling the effectiveness of the reagents.

It would be desirable to provide a simple one step system having a minimum of components but long shelf life and capability of being carried out rapidly and efficiently on a commercial scale through the use of simple apparatus.

The improved photographic processing system of the present invention and the improved photographic process employing such system satisfy the foregoing needs. The system employs a novel photographic recording medium and a novel processing web. THe medium includes a barrier layer which isolates the silver halide from developer prior to developing. The barrier layer is characterized by being insoluble in water and acidic media but soluble in aqueous alkaline media. The developer is mixed with the barrier material or coated as a separate layer thereon. Since the developer is carried on the recording medium in an acidic environment, it is effectively protected from deterioration. The alkaline activator is carried on the processing web, along with any fixer to be used. When the web contacts the developer, the activator activates the developer and causes penetration of the developer through the barrier layer material to effect the desired development. Fixer from the web then renders the developed image permanent.

Contacting of the developer-containing layer with the processing web can be accomplished through simple automated apparatus using conventional guide rollers, pinch rollers and drive equipment. The processing web usually carries free water so that the activator is an aqueous alkaline solution. However, a free water-yielding material in the web can be used to yield free water on heating or to react with one or more components of the developer layer to release free water and provide the aqueous alkaline activator solution during contacting. Accordingly, the desired photographic processing can be accomplished very simply and effectively. Details of the process and system are set forth in the following specific description and accompanying drawings.

Prior art includes the following U.S. Pat. Nos.: 2,543,181, 2,572,357, 2,992,102, 3,248,219, 3,369,901, 3,468,664, 3,552,971, and T870,007.

BRIEF DESCRIPTION OF THE DRAWINGS

FIG. 1 schematically depicts, in enlarged fragmentary view, one embodiment of the processing system of the invention in use during developing;

FIG. 2 schematically depicts, in greatly enlarged fragmentary cross section, the improved photographic recording medium depicted in FIG. 1; and FIG. 3 schematically depicts in greatly enlarged fragmentary cross section the improved processing web depicted in FIG. 1.

DETAILED DESCRIPTION

Referring to FIG. 1, the present improved photographic processing system is shown. The system 10 comprises a novel photographic recording medium 12 and a novel processing web 14. The web 14 in contact with the medium 12 between a pair of pinch rollers 16 so as to effect development of an image carried in the medium 12. The present process includes this contacting step following the exposure of the recording medium to a pattern of light. Contact between the web 14 and the medium 12 is broken after each passes beyond a pinch gap 18 between the rollers 16.

Referring to FIG. 2, one embodiment of the improved photographic recording medium 12 is schematically shown in greatly enlarged cross-section, wherein separate barrier and developer layers are used. The medium 12 includes a base support 20 which can be of paper, gelatin, plastic or the like. The base support 20 can be eliminated, if desired, since the remainder of the medium 12 can be made self-supporting. Secured to and disposed over the support 12 is a silver halide-containing emulsion layer 22 of conventional fabrication and components. Thus, the silver halide can be silver chloride, silver bromide or silver iodide dispersed within a conventional emulsion wherein the dispersant is, for example, gelatin, albumen or the like, or other emulsion well known in the art and susceptible of penetration by the developer hereinafter more particularly described.

A barrier layer 24 is disposed on the surface of emulsion layer 22 opposite that contacting the support 20. The barrier layer 24 is of a selected material which is insoluble in water and acidic media, such as aqueous acidic media, but is soluble in aqueous alkaline media. For such purposes, it has been found that selected copolymers sold under the trademark GANTREZ by General Aniline and Film Corporation are suitable, particularly those of the GANTREZ-AN3000 series.

Such copolymers are those of methyl ethyl ether and maleic anhydride which have been reacted with alcohols, particularly alkyl monols, to convert the anhydride to acid and ester linkages, i.e. to form monoalkyl ester copolymeric derivatives of methyl ethyl ether - maleic anhydride copolymers.

Other suitable copolymers can also be used for the barrier layer 24, such as copolymer resins of vinyl acetate and maleic anhydride sold under the trademark GFLVA by Monsanto Company, St. Louis, Mo. It will be understood that the barrier layer 24 must have the above-described solubility and insolubility characteristics amd nust be sufficiently thick and uniform to assure isolation of the silver halide from the developer (in the next layer to be described) prior to development. Moreover, it must be lighttransmitting if the support 20 is used in the medium 12 and the support 20 is not light transmitting.

As shown in FIG. 2, disposed on the surface of the barrier layer 24 opposite that contacting the emulsion layer 22 is a developer layer 26 comprising alkaline activatable developer for the silver halide in a suitable binder, such as gelatin or the like. Such binder should permit ready penetration therethrough of alkaline activator for the developer and activated developer, as well as fixer, providing free water is present. Other suitable water soluble developer binders include agar, polyvinyl alcohol, sodium alginate, carrageenan, vegetable gum and mixtures thereof and similar hydrophilic colloids. Although shown as a separate layer, the developer can be incorporated directly into the barrier layer 24 by admixing directly therewith prior to coating on the emulsion layer 22. Any suitable alkaline activatable developer for the silver halide can be used, for example catechol, hydroquinone, toluhydroquinone, o-chlorohydroquinone, o-bromohydroquinone, 4-phenyl catechol, 4-t-butyl catechol, pyrogallol, 4-butyl-pyrogallol nordihydroquiauretic acid, 4,5-dibromocatechol, 3,5,6-tribromo-4-phenyl catechol, 1-phenyl-3-pyrazolidone, ascorbic acid, phenidone B, and the like conventional reagents, or mixtures thereof. The developer is in an acidic environment, either by virtue of its chemical nature or by the addition to the layer 26 of an acidic substance, such as ascorbic acid (which as above listed itself is a developer) or controlled amounts of mineral acids or acid salts. This acidic environment effectively protects the developer from deterioration due to atmospheric oxidation, thereby substantially increasing shelf life of the recording medium 12 over many conventional recording media which include one or more processing reagents. IF the support 20 is used and is not light transmitting, the layer 26 as well as the layer 24 must be light transmitting.

The thickness of the layers and support shown in FIG. 2 are not to scale and will, of course, vary, depending on the materials used. Ordinarily, the total thickness of the layers deposited over the silver halide emulsion is about 0.1–2 mil.

Referring to FIG. 3, the web 14 comprises an alkaline activator, such as sodium hydroxide, potassium hydroxide, sodium carbonate, or the like inorganic material, or an organic alkali such as 1,3-propanediamine, diethanolamine or the like, or mixtures thereof disposed in a gel layer 14 backed by a flexible support 15 such as paper, paperboard, plastic, or the like. The gel may be, for example, a set aqueous gel of agar, gelatin, sodium alginate, carrageenan, vegetable gums, mixtures thereof, or the like. Also present in the web 14 is a free water source which can be free water itself or an agent which preferably chemically reacts with the layer 26 to yield free water during contacting of the web 14 therewith or which can be heated to release free water. For the latter type, Glauber salt, borax, sodium alginate or the like can be used. Moreover, suitable removable packaging (not shown) can be used to retain the free water in the web 14 before use. Reaction of an inorganic alkali activator in the web 14 with carboxyl groupcontaining acid in the layer 26 yields free water.

The activator should be present in a concentration sufficient to activate enough developer to accomplish the desired latent image development. For example, a concentration of between about 0.5% and about 15% of activator, by weight in the web coating formulation is usually sufficient depending on choice of activator and coating thickness. Other relative concentrations can also be used. The web can be about 0.5–25 mil thick.

It will be understood that if the barrier layer 24 comprises material such as one of the GANTREZ AN-3000 series copolymers, carboxyl groups in the layer 24 can react with alkali from the web 14 also to provide free water during and after contacting of the web 14 with the medium 12 so as to provide free water or supplement available free water and facilitate penetration of the layer 24 by the developer.

The web 14 can also include a fixer or complexing agent such as a thiosulfate, for example, sodium thiosulfate, ammonium thiosulfate or potassium thiosulfate, sodium sulfite (which also acts as an antioxidant), the lower aliphatic amines, a thiocyanate such as ammonium thioxyanate, or sodium or potassium thiocyanate, or thiourea, or the like conventional fixer. Such fixer is used in a concentration of about 3.5–15.0% and is transferred to the layer 26 along with the described alkali to permanently fix the image developed in the emulsion layer 22 upon migration to the emulsion layer 22. Moreover, one can include nucleating agents to precipitate undeveloped silver onto the web. Such materials are well known. Thus one can add metallic sulfides, particularly of the heavy metals such as lead, cadmium, nickel, zinc or silicon, metallic selenides such as those of lead, nickel, zine or antimony. colloidal metals such as the precious metals such as silver and gold, or precursors thereto. For example, $Na_2S$, $AgNO_3$ and $Cd(C_2H_3O_2)_2$. Fog inhibitors, such as KBr, antioxidants, such as $Na_2SO_3$, moisturizers, such as ethylene glycol and can all be added for their known purpose.

Supplemental developers also can be present in the web 14 for transfer to the layer 26 and then to the layer 22 through the layer 24. Such supplemental developers can be, for example, monomethyl-p-amino phenol, 1-phenyl-3-pyrazolidone or the like which act synergistically with the primary developer. However, such supplemental developers are not necessary for proper development in accordance with the present process and system.

By including nucleating and complexing or fixing agents, a diffusion transfer mode is accomplished so that virtually all of the unused silver halide is removed in one step, and a positive print is obtained.

In carrying out the present process, the medium 12 is first exposed to a pattern of light, such that a latent image is formed in the layer 22. The medium 12 is then passed into contact with the web 14, as by the guide rollers (not shown) and the pinch rollers 16, as per FIG. 1, so that the web 14 abuts the layer 26, transferring alkaline activator (and fixer and/or supplemental developer, if present) thereto. Free water is also transferred or formed to dissolve the activator and form an aqueous alkaline solution. Such solution activates the developer in the layer 26 and dissolves the layer 24 sufficiently to allow penetration of the developer to the layer 22 and development of the latent image to a visible image. Supplemental developer and/or fixer, if present, also penetrate to the layer 22 to, respectively, help such development and fix the image permanently.

Contact between the web 14 and the medium 12 is broken after the described transfer, whereupon the developed (and usually fixed) recording medium 12 is recovered as an end product, the web 14 being discarded. Thus, lone strips of the medium 12 can be very rapidly and automatically processed in the described manner in very simple inexpensive equipment. The following specific Examples illustrate certain features of the invention:

Example 1

A silver bromide in gelatin emulsion on a polyester support (subbed for aqueous coating) is overcoated with a barrier layer of GANTREZ AN-3000 to a thickness of 0.2 mil. To 100 ml. of a 3.0% by weight solution of 72-60 Elvanol (a polyvinyl alcohol sold by DuPont) are added 1 gram of hydroquinone, 1.2 grams of ascorbic acid and 0.2 gram of Phenidone B as developing agents. The mixture is coated onto the gelatin emulsion to a thickness of about 0.2 mil.

A gel web is prepared by adding, in order, the following components to 235 ml. of water: 1.0 gram of potassium bromide, as fog inhibitor; 1.0 gram of sodium sulfite, as antioxidant; 15.0 grams of sodium hyposulfite as fixer; 7.95 grams of sodium carbonate and 15.0 ml. of a normal sodium hydroxide solution as activators; 10.0 ml. of ethylene glycol as a moisturizer; and 8.0 grams of a commercial gelling agent sold under the trade name Gelcarin HWG (a natural carbohydrate from seaweed). The foregoing components are brought to about 94°C with rapid stirring and the following components are added dropwise, with stirring: 4.0 ml. of a 1 weight percent solution of sodium sulfide, 4.0 ml. of a 2 weight percent solution of silver nitrate and 2.0 ml. of an 0.9 weight percent solution of cadmium acetate, all as a combination forming a nucleating system for silver; and 8.0 drops of a commercial surfactant sold under the trade name of TX-100 (25% in isopropyl alcohol).

The temperature of the resulting solution is adjusted to 96°C and the solution is coated on baryta paper at about 4.5 feet per minute in two passes to attain a thickness of about 12 mil.

The photographic medium is exposed to a light pattern, after which the processing web is placed in contact with the developer layer by means of pinch rollers, to remain together for about 60 seconds to transfer active components of the web to the developer layer and initiate development. Thereafter the web is removed to yield a visible image in the photographic layer and a positive print on the web.

EXAMPLE 2

The procedure of Example 1 can be followed except that in place of the separately coated barrier and developer layers, one adds the same amount of hydroquinone, ascorbic acid and Phenidone B directly to the Gantrez AN-3000, to obtain similar favorable results.

The novel photographic recording media of the present invention can be readily developed (and fixed) by the novel processing web of the invention, in accordance with the present process and system. The process and system can be automated with little expense. Moreover, the storage life of the web and recording medium is substantially increased over that of the components of many conventional pseudo-dry processing systems. Other advantages are set forth in the foregoing.

What is claimed is:

1. An improved photographic recording medium comprising:

a layer of silver halide emulsion;

a barrier layer, soluble in aqueous alkali but insoluble in water and acidic media, disposed on a surface of said emulsion layer, said barrier layer comprising a material selected from the group consisting of: a monoalkyl ester-containing copolymer derivative of methyl ethyl ether-maleic anhydride copolymer, and a vinyl acetate-maleic anhydride copolymer; and an acidic developer for said silver halide with said barrier layer, said developer being activatable at an alkaline pH.

2. The improved recording medium of claim 1 wherein said developer is formed as a layer disposed on the surface of said barrier layer opposite the barrier layer surface contacting said emulsion.

3. The improved recording medium of claim 1 wherein said copolymer comprises monoalkyl ester-containing copolymer derivative of methyl ethyl ether-maleic anhydride copolymer.

4. The improved recording medium of claim 1 wherein said copolymer comprises a vinyl acetate-maleic anhydride copolymer.

5. An improved photographic process, which process comprises:

exposing a photographic recording medium to a pattern of light, said medium comprising:

a layer of silver halide emulsion;

a barrier layer, soluble in aqueous alkali but insoluble in water and acidic media, disposed on a surface of said emulsion layer, said barrier layer comprising a material selected from the group consisting of: a monoalkyl ester-containing copolymer derivative of methyl ethyl ether-maleic anhydride copolymer, and a vinyl acetate-maleic anhydride copolymer; and an acidic developer being activatable at an alkaline pH:

contacting said developer with a processing web free of alkali-activatable silver halide developer comprising a support containing an alkali and a free water source, to activate said developer and cause penetration thereof through said barrier layer for development of said silver halide; and terminating said contacting and recovering said developed recording medium.

6. The improved process of claim 5 wherein said developer is formed as a layer disposed on the surface of said barrier layer opposite the barrier layer surface contacting said emulsion.

7. The improved process of claim 5 wherein said web contains free water and a fixer for a developed silver halide image.

8. The improved process of claim 5 wherein said web contains an agent which releases free water upon chemical reaction with said developer layer.

9. The improved process of claim 5 wherein said copolymer comprises a monoalkyl ester-containing copolymer derivative of methyl ethyl ether-maleic anhydride copolymer.

10. The improved process of claim 5 wherein said copolymer comprises a vinyl acetate-maleic anhydride copolymer.

* * * * *

UNITED STATES PATENT AND TRADEMARK OFFICE

CERTIFICATE OF CORRECTION

PATENT NO. : 3,930,859

DATED : January 6, 1976

INVENTOR(S) : Richard A. Corrigan

It is certified that error appears in the above-identified patent and that said Letters Patent are hereby corrected as shown below:

Column 2, line 35, after "14" , second occurrence insert -- is --.

Column 3, line 52, change "IF" to --If--.

Signed and Sealed this

*eleventh* Day of *May 1976*

[SEAL]

*Attest:*

RUTH C. MASON
*Attesting Officer*

C. MARSHALL DANN
*Commissioner of Patents and Trademarks*